US008925721B2

(12) United States Patent
Young

(10) Patent No.: US 8,925,721 B2
(45) Date of Patent: Jan. 6, 2015

(54) COMPUTER CASE AND STAND WITH INTEGRATED PILLOW

(71) Applicant: Jordan Young, Ridgefield, CT (US)

(72) Inventor: Jordan Young, Ridgefield, CT (US)

( * ) Notice: Subject to any disclaimer, the term of this patent is extended or adjusted under 35 U.S.C. 154(b) by 25 days.

(21) Appl. No.: 13/711,937

(22) Filed: Dec. 12, 2012

(65) Prior Publication Data

US 2014/0158563 A1 Jun. 12, 2014

(51) Int. Cl.

| | |
|---|---|
| ***B65D 85/00*** | (2006.01) |
| ***B65D 81/02*** | (2006.01) |
| ***A45C 11/00*** | (2006.01) |
| ***A45F 5/10*** | (2006.01) |
| ***A45C 13/00*** | (2006.01) |

(52) U.S. Cl.

CPC . *A45C 11/00* (2013.01); *A45F 5/10* (2013.01); *A45C 13/004* (2013.01); *A45C 2011/033* (2013.01); *A45F 2200/0525* (2013.01)

USPC ..... 206/320; 206/480; 206/521

(58) Field of Classification Search

USPC ..... 206/305, 320, 477–483, 521, 523

See application file for complete search history.

(56) References Cited

U.S. PATENT DOCUMENTS

| | | | | |
|---|---|---|---|---|
| 6,264,029 | B1 * | 7/2001 | Motson | 206/320 |
| D497,051 | S * | 10/2004 | Nieves | D3/301 |
| 8,479,915 | B2 * | 7/2013 | Chen | 206/320 |
| 2003/0132127 | A1 * | 7/2003 | Miller et al. | 206/320 |
| 2005/0072893 | A1 | 4/2005 | Brown | |
| 2009/0230006 | A1 * | 9/2009 | Pidgley et al. | 206/320 |
| 2012/0060724 | A1 | 3/2012 | Doss et al. | |
| 2012/0091025 | A1 * | 4/2012 | Wyner et al. | 206/523 |

* cited by examiner

*Primary Examiner* — Bryon Gehman

(74) *Attorney, Agent, or Firm* — Sofer & Haroun, LLP

(57) ABSTRACT

The present arrangement provides for an arrangement for storage, transport and display of an electronic device. The arrangement has a clip having a first side for securing an electronic device, and a second side, opposite the first side, having a central connection region. The arrangement also has a case with a first flap and a second flap secured along at least one sewn seam, with a zipper arrangement for closing and opening the first and second flaps, the case further includes a base pad, also connected at the sewn seam. The base pad is coupled to the second flap with a collapsible fabric compartment therebetween, the collapsible fabric compartment configured to removably hold a correspondingly shaped support. The base pad has a substantially centrally located attachment pad, substantially corresponding to the central connection region of the clip, for securing the clip and the electronic device to the base pad.

14 Claims, 14 Drawing Sheets

COMPUTER CASE AND STAND WITH INTEGRATED PILLOW

BACKGROUND

1. Field of the Invention

This application relates to a computer case. More particularly, this application relates to a convertible travel computer case and stand.

2. Description of Related Art

In the area of travel computer cases there are numerous designs that focus on various aesthetic and protective qualities. For example, various leather and hard shell brief case style computer travel cases are designed for aesthetic appeal. Although they provide adequate protection for computers, including tablets/tablet computers, mini tablets and e-reader type devices, they are not designed as multi-functional cases. Given the limited space during travel, particularly in the case of airline travel, such cases may be overly space consuming.

Other computer and pad-computer type cases focus primarily on safety. These cases are designed usually with thick padding on both sides of the enclosed computer. Although such designs provide good protection for the computer, they tend to be bulky and not well suited to limited travel space.

OBJECTS AND SUMMARY

The present arrangement looks to overcome the drawbacks associated with the prior art to provide a travel computer case that not only provides protection for the computer, but additionally provides multi-functional items, such as a travel pillow, a carrier clip, a presentation handle and a support strap. Moreover, the case arrangement is designed to be compressible and sized to be ideal for travel in confined spaces, such a airline and train travel.

To this end, the present arrangement provides for an arrangement for storage, transport and display of an electronic device. The arrangement has a clip having a first side for securing an electronic device, and a second side, opposite the first side, having a central connection region. The arrangement also has a case with a first flap and a second flap secured along at least one sewn seam, with a zipper arrangement for closing and opening the first and second flaps, the case further includes a base pad, also connected at the sewn seam.

The base pad is coupled to the second flap with a collapsible fabric compartment therebetween, the collapsible fabric compartment configured to removably hold a correspondingly shaped support. The base pad has a substantially centrally located attachment pad, substantially corresponding to the central connection region of the clip, for securing the clip and the electronic device to the base pad.

BRIEF DESCRIPTION OF THE DRAWINGS

The present invention can be best understood through the following description and accompanying drawings, wherein.

DETAILED DESCRIPTION

Figure 1:
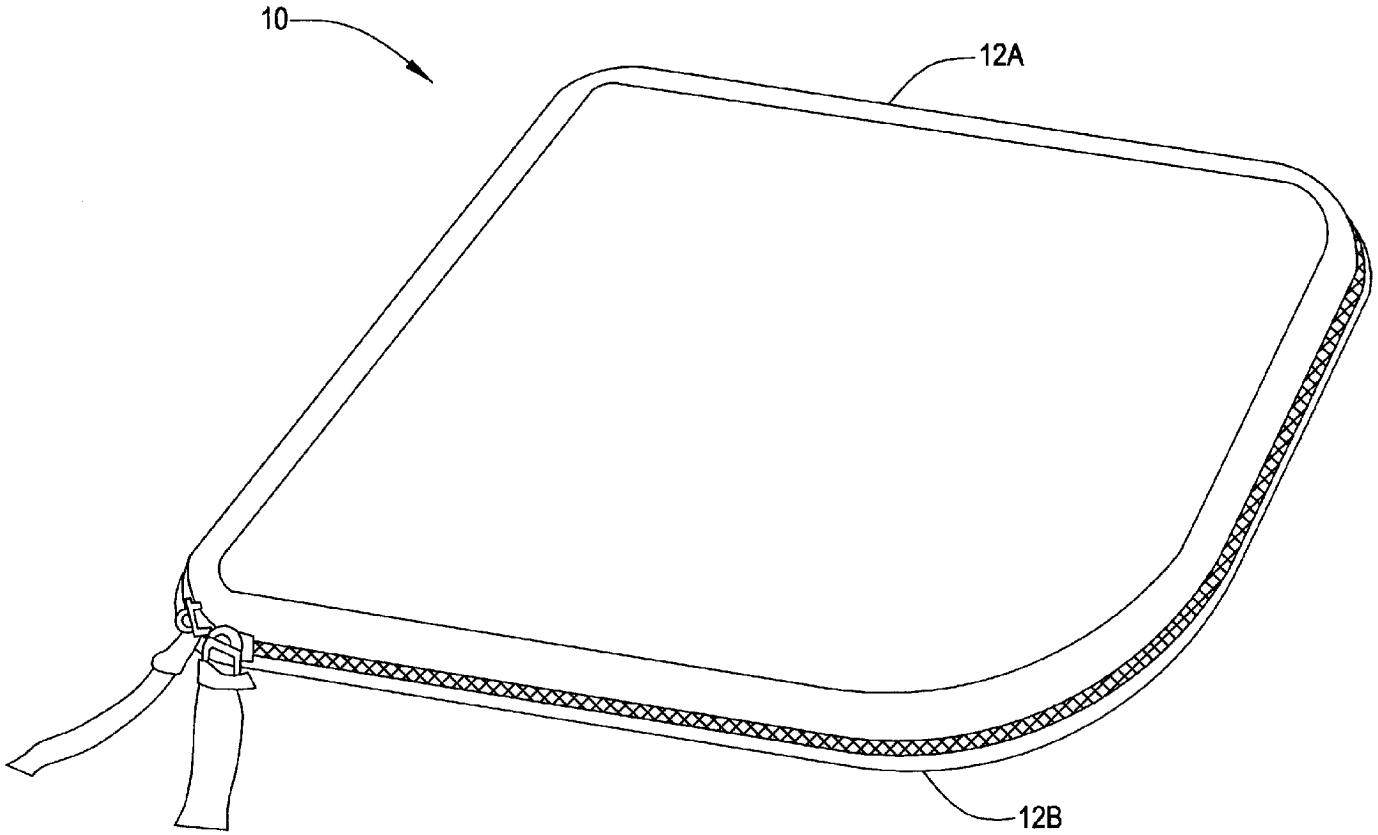
FIG. 1 shows a computer case according to one embodiment.
Figure 2:
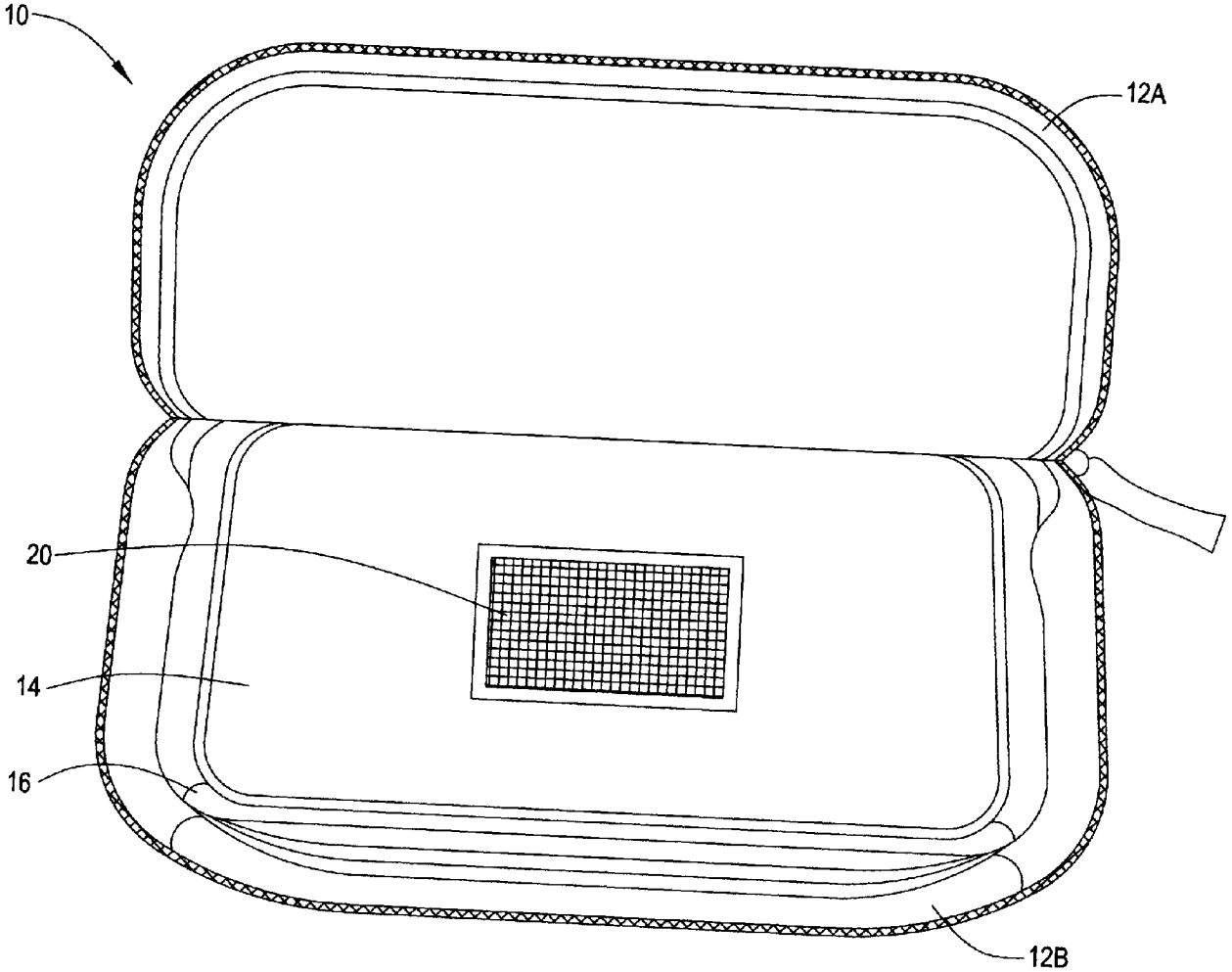
FIG. 2 shows the computer case of FIG. 1 in an open arrangement, according to one embodiment.

In one embodiment as shown in FIG. 1 a travel computer case 10 is shown having a top flap 12*a* and a bottom flap 12*b*. As illustrated, the shape of flaps 12*a* and 12*b* are substantially rectangular with one sewn seam and three open ends enclosable using a zipper. Ideally, case 10 is made from materials such as neoprene, lycra, spandex cotton, foam EVA and blended materials, but the invention is not limited in this respect. It is understood that other similar materials may be used. As shown in FIG. 2, bottom flap may have a strap on its outside surface for tucking the opened top flap 12*a* therein when case 10 is in an open arrangement.

For the purpose of illustrating the salient features of the invention, case 10 is being described in its ideal shape and sizing for a tablet style computers, mini tablets and e-reader type devices, however, this is in no way intended to limit the scope of the invention. Case 10 may be modified as required to accommodate any similar sized electronic devices on non-tablet (i.e. full laptop) portable computing devices.

Turning to the various features of case 10, FIG. 2 shows case 10 in an open arrangement. In this flattened arrangement, a base pad 14 is arranged on one side of case 10, in connection with bottom flap 12*b*. Base 14 may be made for example of a combination of neoprene and spandex over EVA foam, but other sturdy covered construction options may be used as well. In the center of base pad 14 a recessed attachment pad 20 is arranged to securely hold a tablet/pad style computer as discussed in more detail below. Attachment pad 20 may be made of a typical hook-and-loop fastener such as Velcro™, but other interlocking connection mechanism may be substituted.

Figure 4:
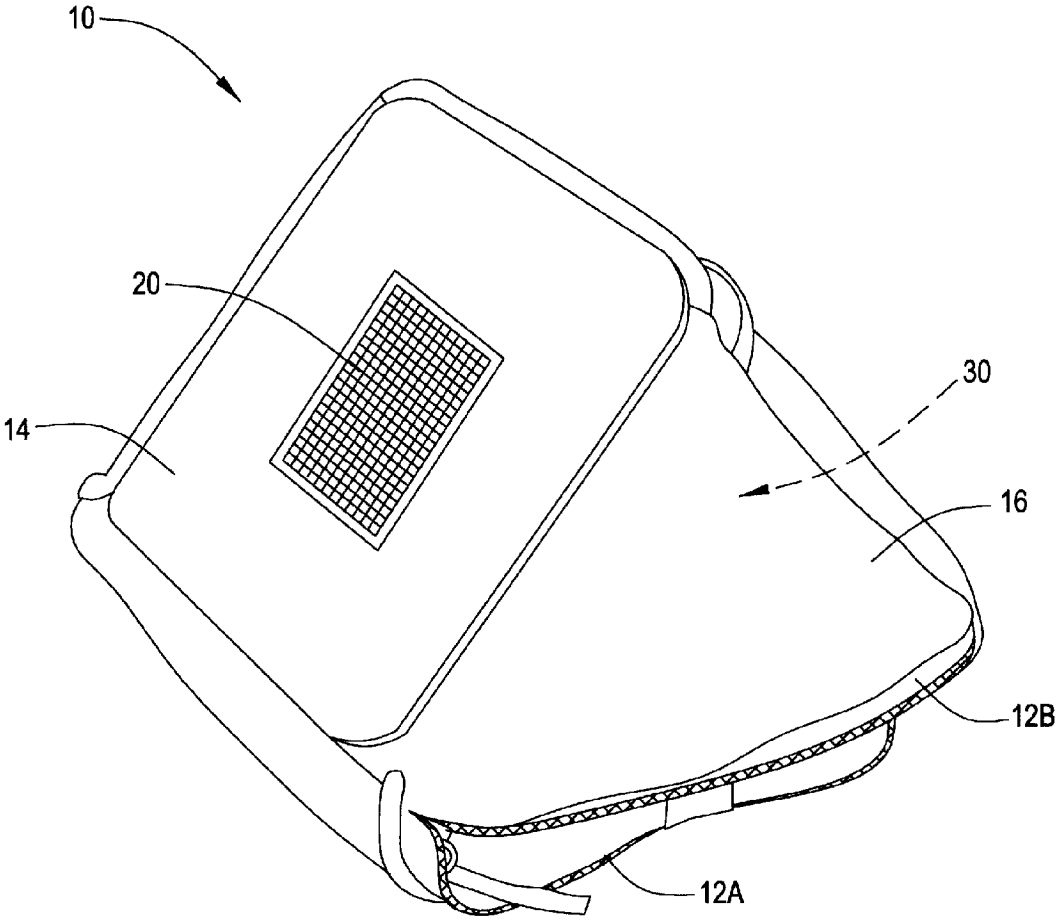
FIG. 4 shows the computer case of FIG. 3 with the pillow inserted therein, according to one embodiment.

It is noted that base pad 14 is not directly connected to the surface of bottom flap 12*b*, but rather is secured to case 10 along the same seam that connects top and bottom flaps 12*a* and 12*b*. Thus, base pad 14 is independently moveable from bottom flap 12*b*. Between base pad 14 and bottom flap 12*a* is a compartment 16 that has a substantially triangular shape. Compartment 16 may be formed for example using spandex and lycra compartment panels as shown in FIG. 4, but other similar fabric materials may be used. As described in more detail below, compartment 16 is configured to receive a shaped pillow through an opening in panels so that base pad 14 is raised away from base flap 12*b* so as to turn base pad 14 into a computer stand. Compartment 16 as shown in FIG. 4 may have an openable slot/seam in the material that is sufficient to fit the pillow therethrough for easy insertion and removal.

Figure 3:
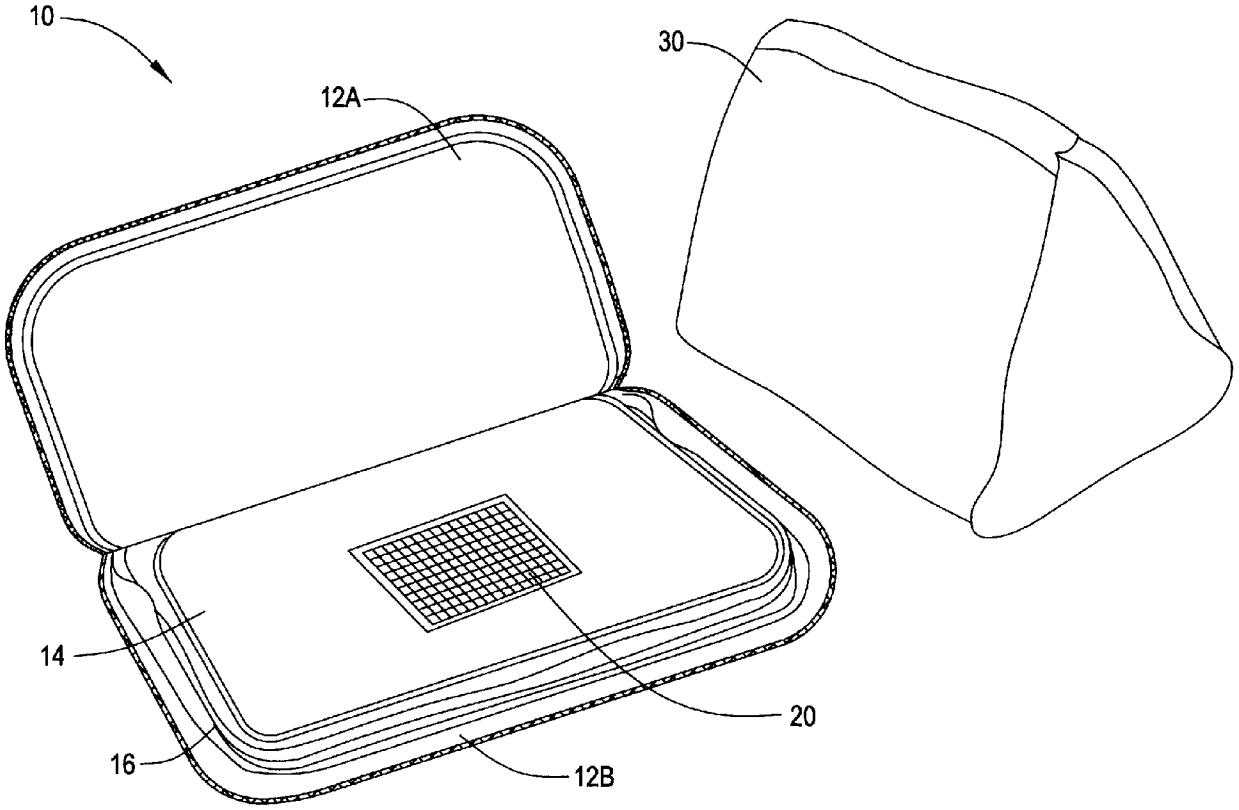
FIG. 3 shows the computer case of FIG. 1 with a pillow, according to one embodiment.

For example, as shown in FIG. 3, a substantially triangular shaped pillow 30 is provided for use with case 10. Pillow 30 is generally a fabric covered filled pillow, possibly with a zippered opening and filled with a pillow filling such as Poly-fil® or other filling materials such as foam or polystyrene beads. Pillow 30 is dimensioned to be used as either one of a personal (i.e. neck/head/lumbar) pillow for use in travel situations or as a insert into compartment 16 of case 10 to form base pad 14 of case 10 into a triangle shaped computer stand as shown in FIG. 4.

It is noted that pillow 30 and compartment 16 are complimentary shapes as triangles however, it is possible that different or modified shapes may be used within the framework of the present invention.

Figure 5:
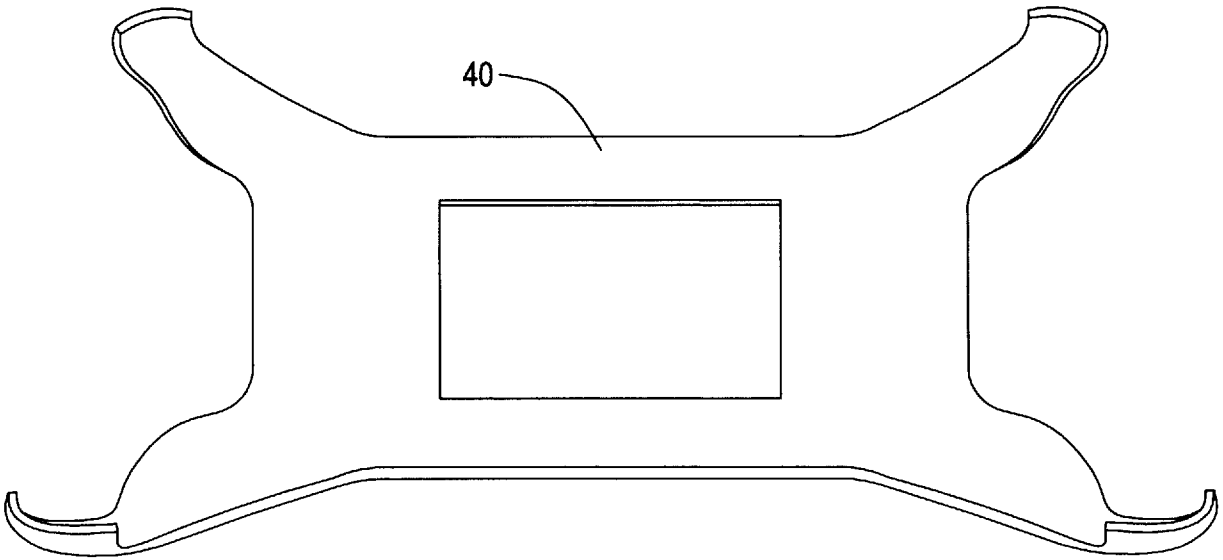
FIG. 5 shows a tablet computer clip, according to one embodiment.
Figure 6:
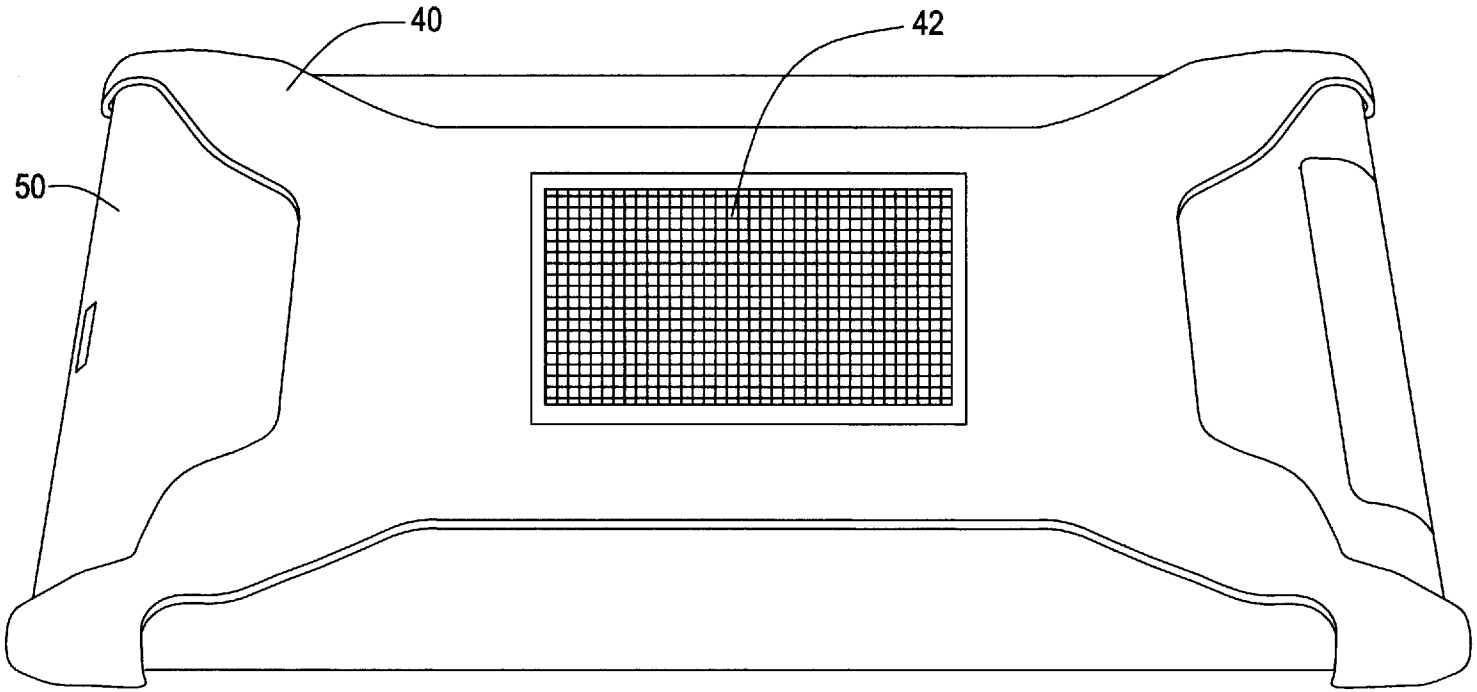
FIG. 6 shows a tablet computer clip with a tablet computer therein, according to one embodiment.
Figure 7:
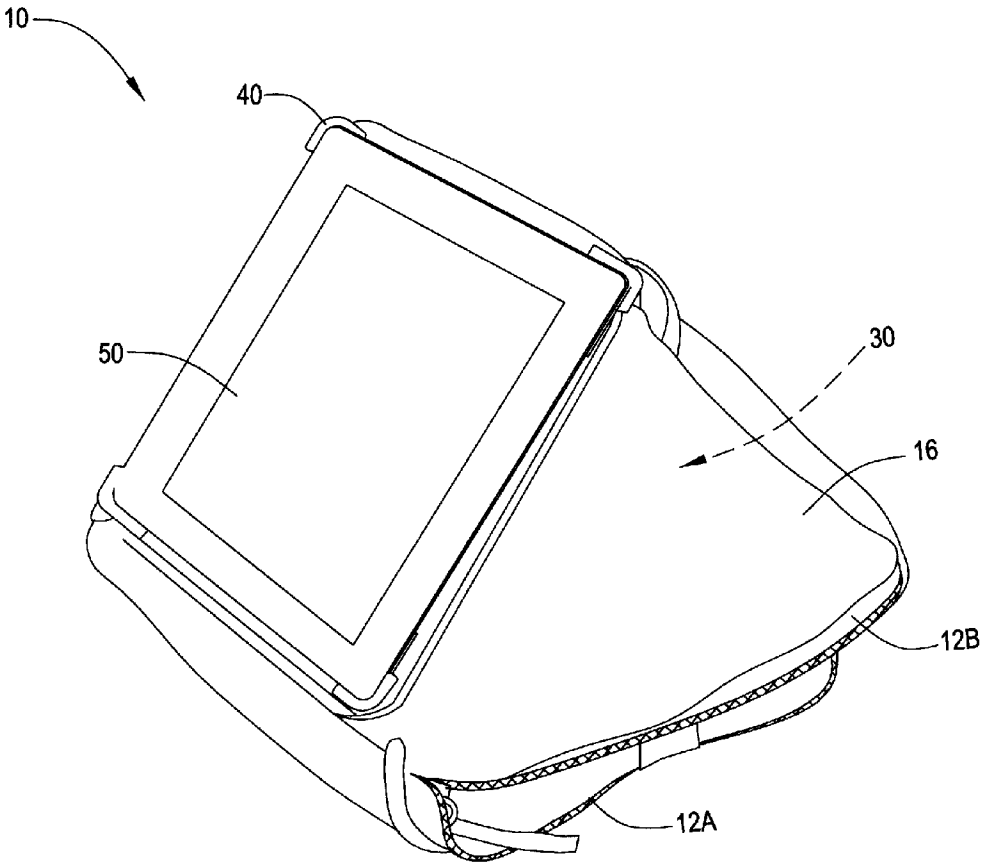
FIG. 7 shows a tablet computer and clip on the computer case of FIG. 3, according to one embodiment.
Figure 8:
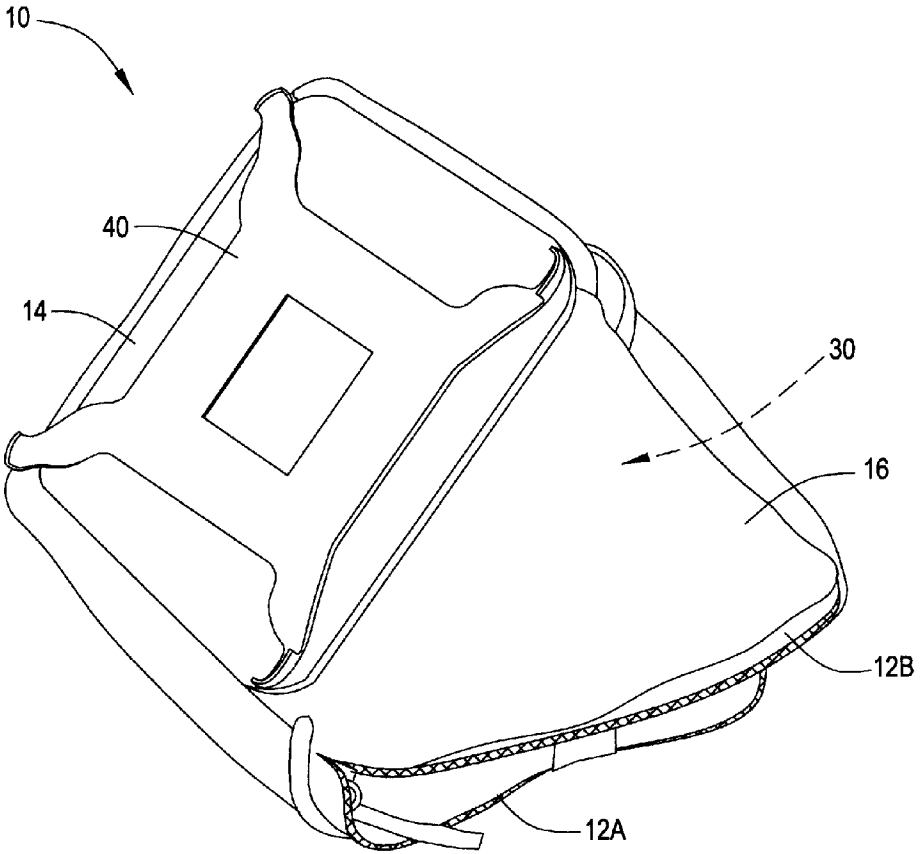
FIG. 8 shows an empty clip on the computer case of FIG. 3, according to one embodiment.

Regarding the attachment of a tablet or pad style computer to base pad 14 of case 10, as shown in FIG. 5, a computer clip 40 is provided. Clip 40 is preferably constructed of molded plastic but other materials may be used as well. As shown in FIG. 6, the four corners of clip 40 are configured to grip the corresponding four clips of tablet computer 50. The central portion of clip 40 has a corresponding connection region 42, such as a hook-and-loop arrangement. As shown in FIG. 7, with tablet computer 50 securely held in clip 40, second hook-and-loop arrangement 42 is fitted onto hook and loop arrangement 20 on base pad 14 (see FIG. 4) resulting in a complete stand for computer 50 that can easily fit on to the lap of a user. For illustrative purposes, FIG. 8 shows the same arrangement of FIG. 7, with computer 50 removed from clip 40.

It is noted that clip 40 and base pad 20, and well as handle 60 and strap clip 70 described below are described as having a hook and loop style connection arrangement. However, it is expressly contemplated that other connection may be used, such as mating latch lugs (female and male), possibly using spring release connections, for providing a more secure connection between the components.

Figure 9:
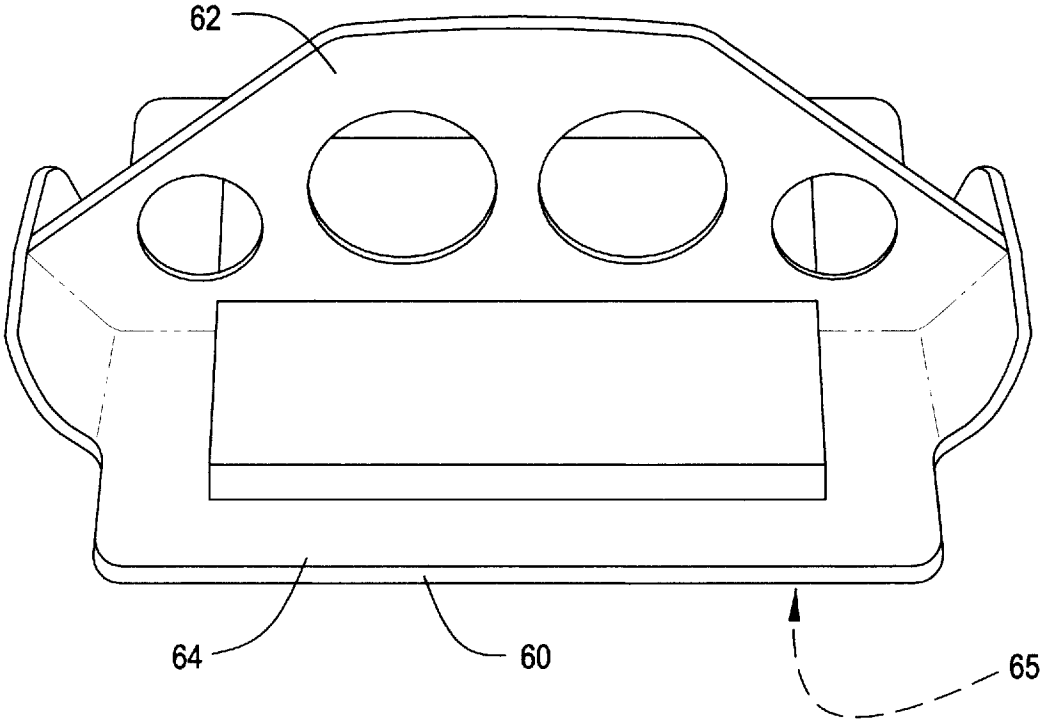
FIG. 9 shows a hand clip, according to one embodiment.
Figure 10:
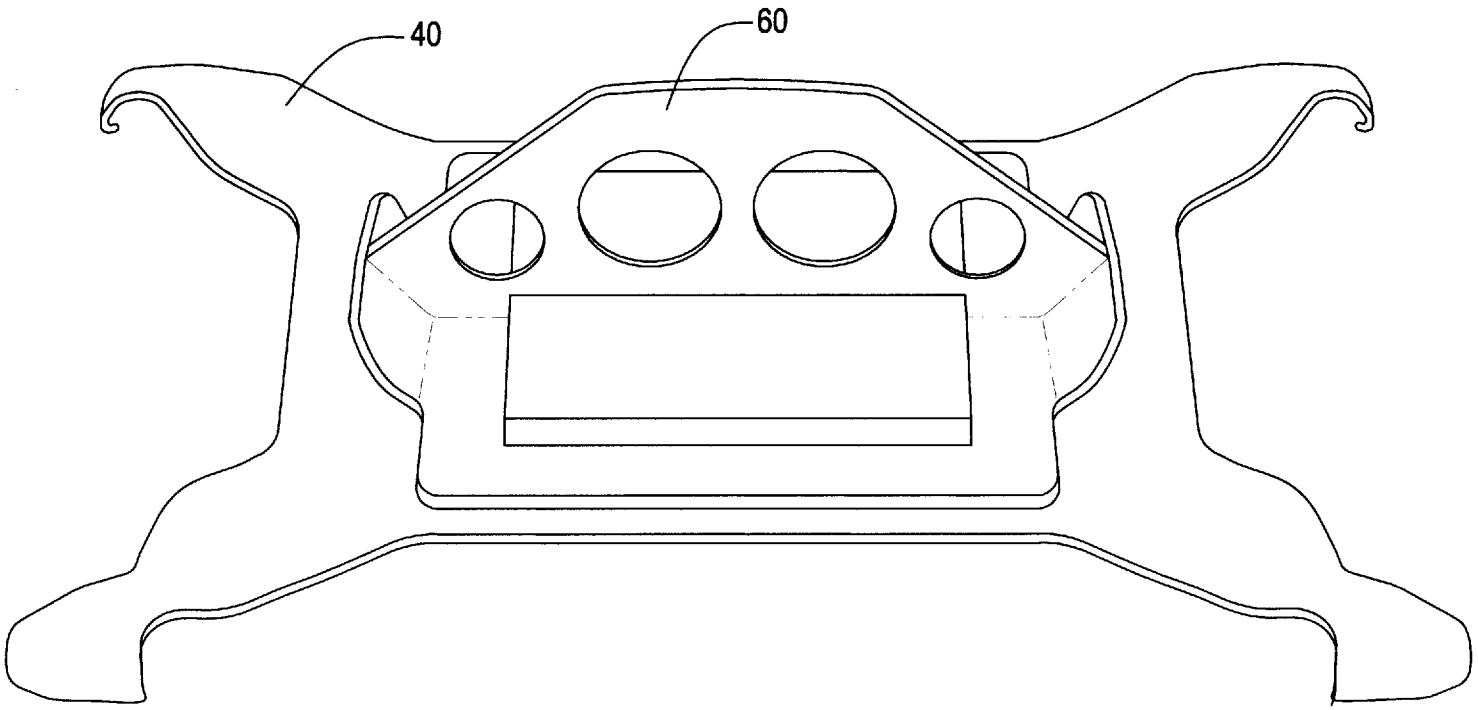
FIG. 10 shows the hand clip of FIG. 9 with the tablet computer clip of FIG. 5, according to one embodiment.
Figure 11:
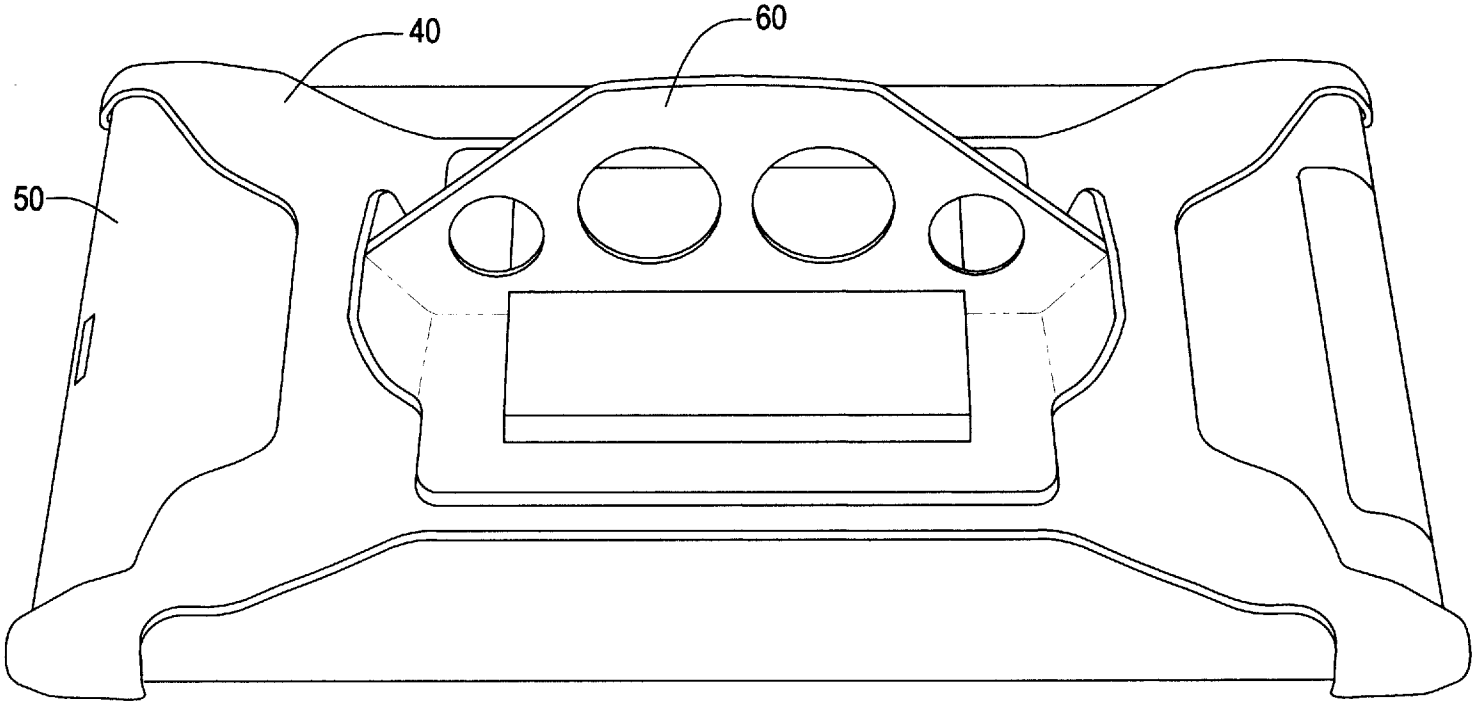
FIG. 11 shows the hand clip of FIG. 9 with the tablet computer clip of FIG. 5 with a tablet computer therein, according to one embodiment.
Figure 12:
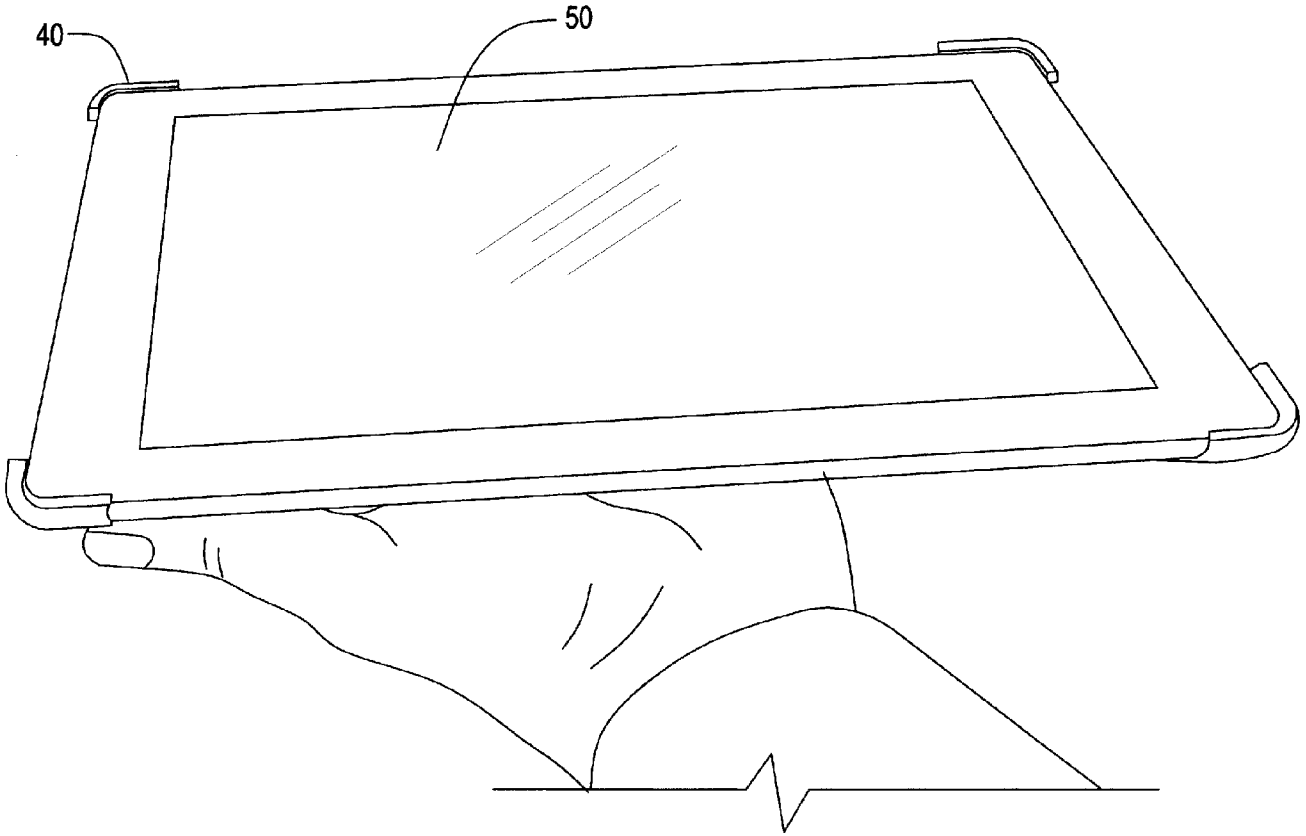
FIG. 12 shows the tablet computer clip of FIG. 5 with a tablet computer therein, being held, according to one embodiment.

In another embodiment, as shown in FIG. 9, a handle 60 is shown for use in conjunction with clip 40. Handle 60 has a finger hole region 62 and base plate 64. Although not shown in FIG. 9, base plate 64 is fitted with a third hook and loop arrangement 65 that is configured to substantially correspond with second hook-and-loop arrangement 42 on clip 40. As shown in FIGS. 10 and 11, second hook-and-loop arrangement 42 on clip 40 and third hook and loop arrangement 65 on handle 60 are connected to form a personal handle holder for computer 50. As shown in FIG. 12, a user can easily use handle 60 to hold computer 50 for presentations and filming video or taking pictures with the tablet, and owing to the size of clip 40 and handle 60 they can fit into case 10, such as in compartment 16 (as pillow 30 is compressible.

Figure 13:
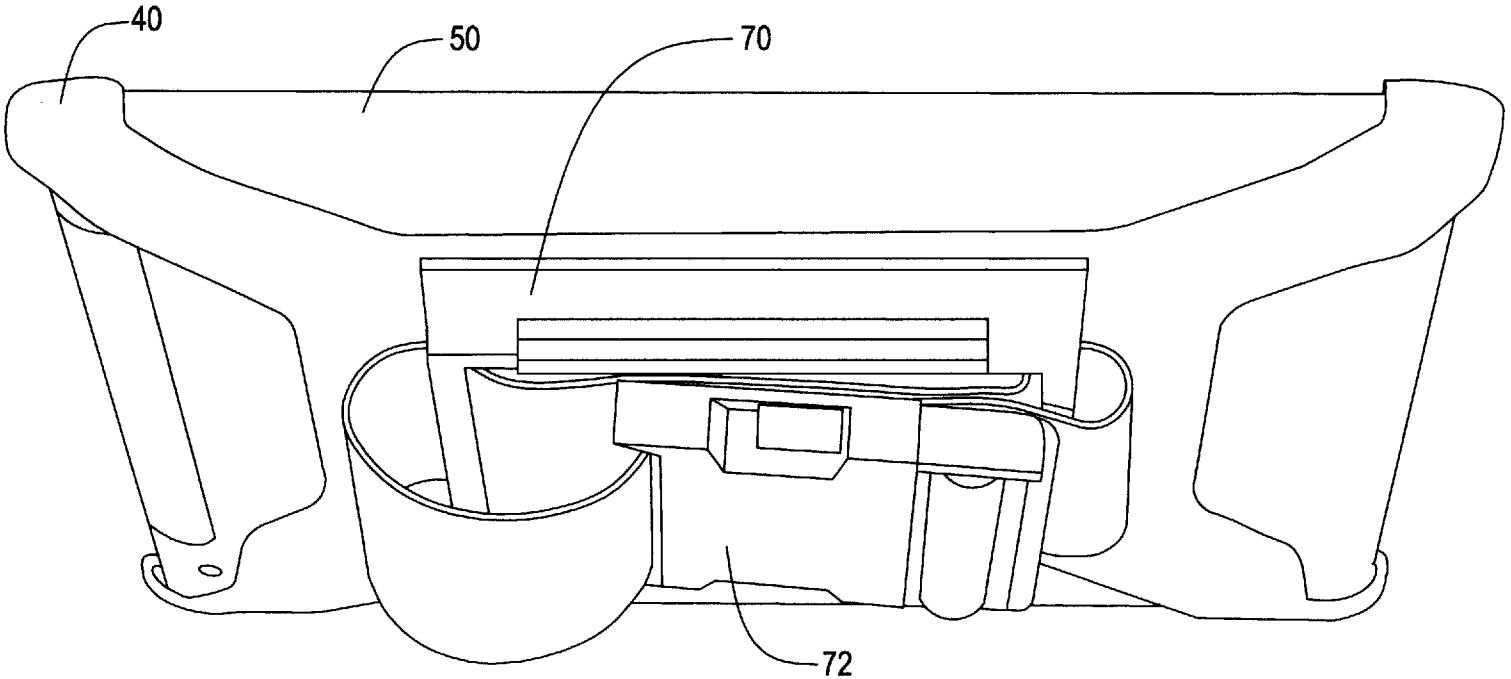
FIG. 13 shows an alternative strap with the tablet computer clip of FIG. 5 with a tablet computer therein, according to one embodiment.

FIG. 13 shows another alternative arrangement, where instead of handle 60, a strap base 70 and strap 72 may be provided, to likewise be used in conjunction with clip 70. As with base pad 14, and handle 60, strap base 70 has a fourth hook-and-loop arrangement (not shown) that couples with second hook-and-loop arrangement 42 on clip 40 allowing clip 40 and computer 50 to be secured to stationary objects using strap 72, such as chair backs, stands or other objects.

Figure 14:
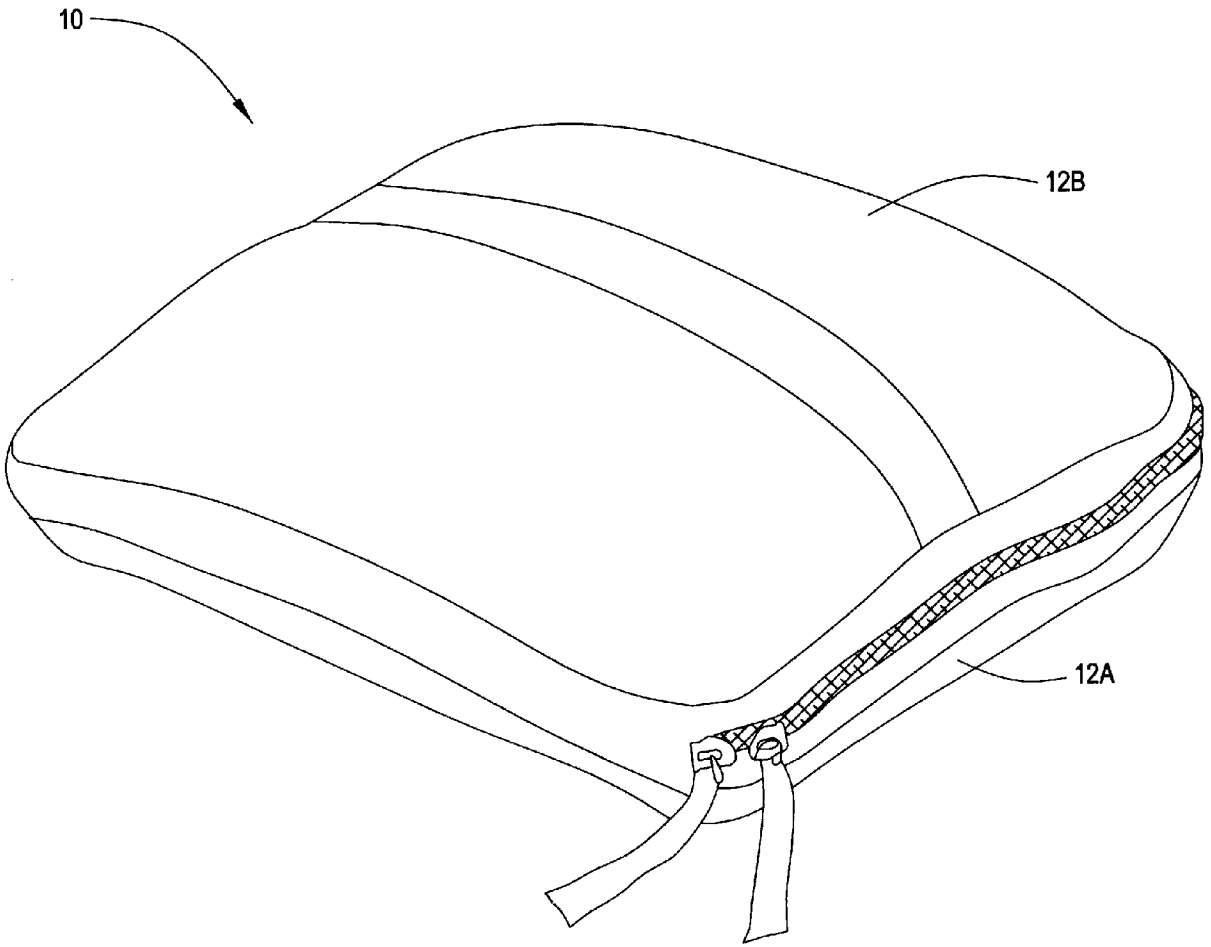
FIG. 14 shows the computer case of FIG. 1 in a closed arrangement, with a tablet computer, clip, pillow and strap therein, according to one embodiment.

Returning to the basic case 10 design, as shown in FIG. 14, all of the above described components are configured to be secured within a closed case 10. With computer 50 in clip 40 attached to base pad 14, and with pillow 30 within compartment 16, all of the components may be compressed, along with handle 60 and strap clip 70 between top and bottom flaps 12*a* and 12*b* to form a dosed computer case as shown. When un-zipped, pillow 30, owing to its resilient filler, would uncompress and return to an open stand configuration as shown for example in FIG. 7.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

The invention claimed is:

1. An arrangement for storage, transport and display of an electronic device, said arrangement comprising:

a clip, said clip having a first side for securing an electronic device, and said clip having a second side, opposite said first side, said second side having a central connection region;

said arrangement further comprising a case, said case having a first outer flap and a second outer flap secured along at least one sewn seam, with a zipper arrangement for closing and opening said first and second flaps, said case further including a base pad, connected at said at least one sewn seam, wherein said base pad is partially coupled to said second flap forming a collapsible fabric compartment therebetween, said collapsible fabric compartment configured to removably hold a correspondingly shaped support, and wherein said base pad has a substantially centrally located attachment pad, substantially corresponding to said central connection region of said clip, for securing said dip and the electronic device to said base pad.

2. The arrangement as claimed in claim 1, wherein said clip is constructed of plastic.

3. The arrangement as claimed in claim 1, wherein said clip has four arms for securing a rectangular shaped electronic device.

4. The arrangement as claimed in claim 3, wherein said clip is dimensioned to secure an electronic device selected from the group consisting of electronic touch screen tablets, tablet laptop computers, mini tablets and e-reader devices.

5. The arrangement as claimed in claim 1, wherein said central connection region of said clip and said attachment pad of said base pad are both constructed with mating hook and loop connection material.

6. The arrangement as claimed in claim 1, wherein said case is constructed from a material selected from the group consisting of neoprene, lycra, spandex cotton and foam EVA.

7. The arrangement as claimed in claim 1, wherein base pad is constructed with neoprene and spandex over EVA foam.

8. The arrangement as claimed in claim 1, wherein said collapsible fabric compartment between said second flap of said case and said base pad of said case is constructed from either one of spandex and lycra.

9. The arrangement as claimed in claim 1, wherein said collapsible fabric compartment between said second flap of said case and said base pad of said case is constructed as an openable triangular shaped compartment.

10. The arrangement as claimed in claim 9, wherein said support is a substantially correspondingly shaped triangular pillow.

11. The arrangement as claimed in claim 1, wherein said arrangement further comprises a handle having a base plate and finger hole region, wherein said base plate of said handle has an attachment mechanism configured to removably couple with said central connection region of said clip, such that the electronic device and clip can be removed from said attachment pad of said base pad and connected to said handle.

12. The arrangement as claimed in claim 1, wherein said arrangement further comprises a strap base and strap, wherein said strap base has an attachment mechanism configured to removably couple with said central connection region of said clip, such that the electronic device and clip can be removed from said attachment pad of said base pad and connected to said strap base.

13. An arrangement for storage, transport and display of an electronic device, said arrangement comprising:

a clip having a first side for securing an electronic device, and a second side, opposite said first side, said second side having a central connection region; and a case, said case having a first flap and a second flap secured along at least one sewn seam, with a zipper arrangement for closing and opening said first and second flaps, said case further including a base pad, also connected at said at least one sewn seam, wherein said base pad is coupled to said second flap with a collapsible fabric compartment therebetween, said collapsible fabric compartment configured to removably hold a correspondingly shaped support, and wherein said base pad has a substantially centrally located attachment pad, substantially corresponding to said central connection region of said clip, for securing said clip and the electronic device to said base pad, wherein said arrangement further comprises a handle having a base plate and finger hole region, wherein said base plate of said handle has an attachment mechanism configured to removably couple with said central connection region of said clip, such that the electronic device and clip can be removed from said attachment pad of said base pad and connected to said handle.

14. An arrangement for storage, transport and display of an electronic device, said arrangement comprising:

a clip having a first side for securing an electronic device, and a second side, opposite said first side, said second side having a central connection region; and a case, said case having a first flap and a second flap secured along at least one sewn seam, with a zipper arrangement for closing and opening said first and second flaps, said case further including a base pad, also connected at said at least one sewn seam, wherein said base pad is coupled to said second flap with a collapsible fabric compartment therebetween, said collapsible fabric compartment configured to removably hold a correspondingly shaped support, and wherein said base pad has a substantially centrally located attachment pad, substantially corresponding to said central connection region of said clip, for securing said clip and the electronic device to said base pad, wherein said arrangement further comprises a strap base and strap, wherein said strap base has an attachment mechanism configured to removably couple with said central connection region of said clip, such that the electronic device and clip can be removed from said attachment pad of said base pad and connected to said strap base.

* * * * *

UNITED STATES PATENT AND TRADEMARK OFFICE

CERTIFICATE OF CORRECTION

PATENT NO. : 8,925,721 B2
APPLICATION NO. : 13/711937
DATED : January 6, 2015
INVENTOR(S) : Young It is certified that error appears in the above-identified patent and that said Letters Patent is hereby corrected as shown below:

In The Claim

Column 4, Claim 1, Line 32: The word “dip” between the words “said” & “and” should read “clip”

Signed and Sealed this
Fourteenth Day of April, 2015

Michelle K. Lee

Michelle K. Lee
*Director of the United States Patent and Trademark Office*